US006588094B2

(12) United States Patent
Furukawa et al.

(10) Patent No.: US 6,588,094 B2
(45) Date of Patent: Jul. 8, 2003

(54) METHOD OF PRODUCING THERMISTOR CHIPS

(75) Inventors: Noboru Furukawa, Shiga (JP); Masahiko Kawase, Shiga (JP); Yasunori Ito, Shiga (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/974,272

(22) Filed: Oct. 9, 2001

(65) Prior Publication Data

US 2002/0036564 A1 Mar. 28, 2002

Related U.S. Application Data

(62) Division of application No. 09/405,655, filed on Sep. 24, 1999.

(30) Foreign Application Priority Data

Oct. 13, 1998 (JP) ..... 10-290803

(51) Int. Cl.[7] ..... H01C 17/00

(52) U.S. Cl. ..... 29/610.1; 29/611; 338/22 R; 338/195; 338/225 D

(58) Field of Search ..... 338/22 R, 22 SD, 338/195, 314, 225 D; 29/610.1, 611, 612

(56) References Cited

U.S. PATENT DOCUMENTS 3,914,727 A * 10/1975 Fabricius ..... 338/22 R
4,486,737 A * 12/1984 Ott ..... 338/22 R
H415 H * 1/1988 Newnham et al. ..... 338/22 R
4,766,409 A * 8/1988 Mandai ..... 338/22 R
5,493,266 A * 2/1996 Sasaki et al. ..... 338/22 R

FOREIGN PATENT DOCUMENTS

JP 02-276203 * 11/1990
JP 03-250603 11/1991
JP 08-162304 6/1996

* cited by examiner

*Primary Examiner*—Carl J. Arbes
(74) *Attorney, Agent, or Firm*—Beyer Weaver & Thomas LLP

(57) ABSTRACT

Thermistor chips are produced by preparing ceramic green sheets, applying an inorganic material such as a glass paste on these green sheets in areas including lines along which they are to be later cut, stacking a plurality of these green sheets one on top of another to obtain a stacked body, obtaining chips by cutting this stacked body along those pre-specified lines and subjecting these chips to a firing process to obtain sintered bodies, and forming outer electrodes on mutually opposite end surfaces of these sintered bodies. A thermistor chip thus produced has a thermistor element having outer electrodes on its mutually opposite end surfaces, and diffused layers of an inorganic material having a higher specific resistance than material of the thermistor element. These diffused layers are formed proximally to externally exposed surfaces of the thermistor element.

6 Claims, 3 Drawing Sheets

METHOD OF PRODUCING THERMISTOR CHIPS

This is a divisional of patent application Ser. No. 09/405,655 filed Sep. 24, 1999, now pending.

BACKGROUND OF THE INVENTION

This invention relates to a method of producing thermistor chips for surface mounting and, in particular, such thermistor chips which may be used for temperature compensation of electronic apparatus or as sensors for measuring surface temperatures.

Thermistor chips have the problem that the exposed areas of the thermistor body become corroded and dissolved when a process of electrolytic plating is carried out on the outer electrodes, thereby causing the value of their resistance to change. Thus, it has been known to form an insulating layer such as a glass layer on the surface of the thermistor body in order to prevent the corrosion of the thermistor body at the time of electrolytic plating. Japanese Patent Publication Tokkai 3-250603, for example, has disclosed a thermistor chip 1 thus produced, as shown in FIG. 7, having outer electrodes 4 formed over two end surfaces of a thermistor element 2 with its outer surfaces completely covered with a glass layer 3 except on these end surfaces.

Such thermistor chips 1 may be produced firstly by printing and baking a glass paste on both main surfaces of a ceramic green sheet to form the glass layers 3 on both main surfaces of a thermistor body 5, as shown in FIG. 8A. After the sintered sheet 6 thus produced is cut into strips 7 by means of a dicing saw, the glass paste is applied by printing and baked also on the cut surfaces to form glass layers 3 thereon, as shown in FIG. 8B. These strips 7 are then cut perpendicularly to these cut surfaces to obtain thermistor elements 2 in chip forms, as shown in FIG. 8C. Baked electrode layers 4*a* (shown in FIG. 7) are formed by applying and baking an electrically conductive paste on the cut surfaces which are the end surfaces of these thermistor elements 2. Plated layers 4*b* (shown in FIG. 7) are further formed over these baked electrode layers 4*a* by an electrolytic plating process to obtain chip thermistors 1 as shown in FIG. 8D wherein numerals 4 indicate electrodes each consisting of a baked electrode layer 4*a* and a plated layer 4*b*.

This method of production is disadvantageous because it includes the step of using a dicing saw to cut the sintered sheet 6 with glass layers 3 formed on both its main surfaces and the step of thereafter applying and baking a glass paste on the exposed cut surfaces and hence is complicated and costly.

SUMMARY OF THE INVENTION

It is therefore an object of this invention to provide a method of producing thermistor chips with a new structure with insulated surfaces.

Thermistor chips having outer electrodes on mutually opposite end surfaces of a thermistor element and diffused layers of an inorganic material having a higher specific resistance than the material of the thermistor element formed proximally to externally exposed areas of the thermistor element may be produced by preparing ceramic green sheets, applying an inorganic material such as a glass paste on them in areas including lines along which they are later to be cut, stacking a plurality of these green sheets one on top of another to obtain a stacked body, obtaining chips by cutting this stacked body along the aforementioned lines and subjecting these chips to a firing process to obtain a sintered body, and forming outer electrodes on mutually opposite end surfaces of the sintered body.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

Throughout herein, like or equivalent components may be indicated by the same numerals even where they are components of different thermistor chips and may not be explained repetitiously for the purpose of simplifying the description.

DETAILED DESCRIPTION OF THE INVENTION

Figure 1:
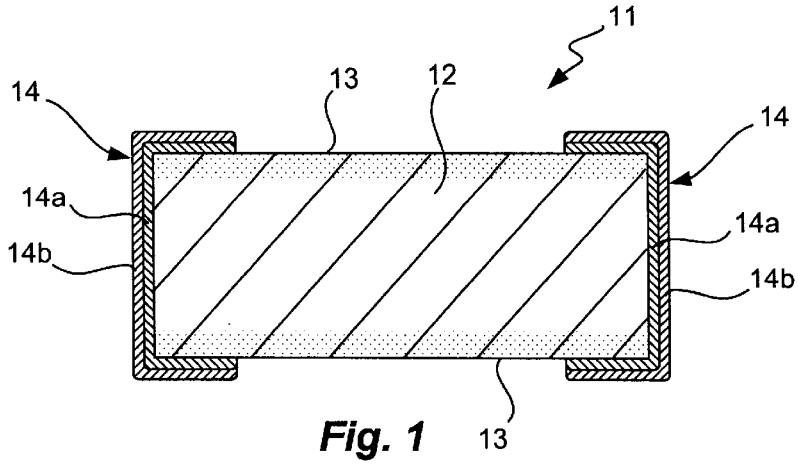
FIG. 1 is a sectional side view of a thermistor chip embodying this invention.

The invention is described next by way of examples. FIG. 1 shows a thermistor chip 11 according to one embodiment of this invention, comprising a an NTC thermistor element 12, diffused layers 13 formed proximally to the external surfaces of the NTC thermistor element 12 except for its end surfaces and outer electrodes 14 formed on these end surfaces of the thermistor element 2. Explained somewhat more in detail, the NTC thermistor element 12 is of the shape of a quadrangular column, as shown more clearly in FIG. 2C, having two mutually oppositely facing end surfaces, and two pairs each of two mutually oppositely facing side surfaces which extend between the two end surfaces.

NTC thermistor chips as shown in FIG. 1 may be produced as follows. Firstly, specified amounts of an organic binder, a dispersing agent, a surface active agent, an anti-foaming agent and a solvent are added to a thermistor material having as its principal constituent one or more oxides together containing two or more metals selected from a group consisting of Mn, Ni, Co, Fe, Cu and Al to form green sheets 15 of thickness 40–60 m and it is cut to a specified size. Outer-layer green sheets 17 are made by printing on one of the main surfaces of these green sheets 15 a glass paste 16 comprising zinc borosilicate as its main ingredient. Inner-layer green sheets 18 are made by printing the same glass paste 16 in parallel lines with specified intervals therebetween on one of the main surfaces of the green sheets 15 inclusive of positions at which they are intended to be cut later.

Figure 2A:
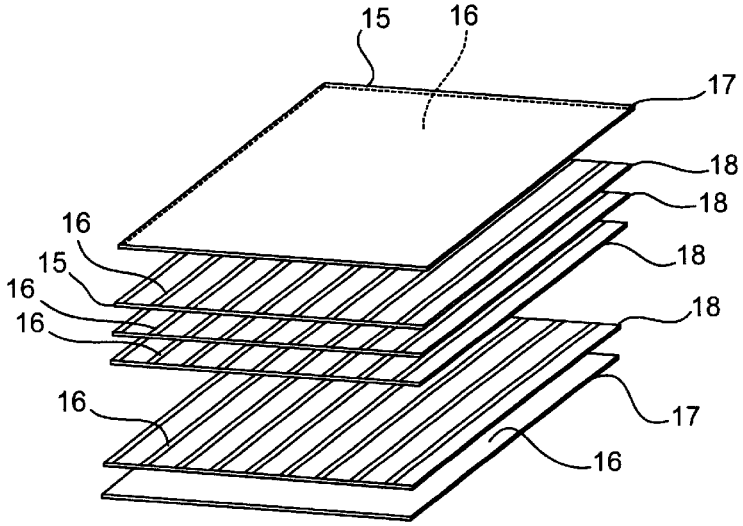
FIGS. 2A, 2B, 2C and 2D, together referred to as FIG. 2, are diagonal views of the thermistor chip of FIG. 1 at various stages of its production.
Figure 2B:
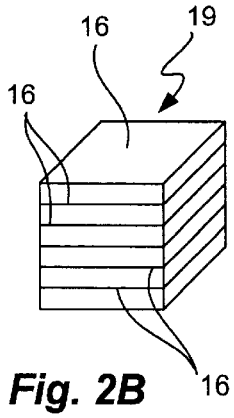
Figure 2C:
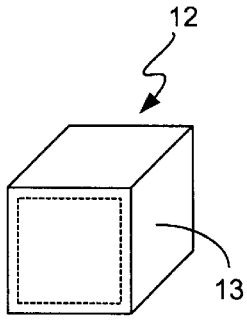
Figure 2D:
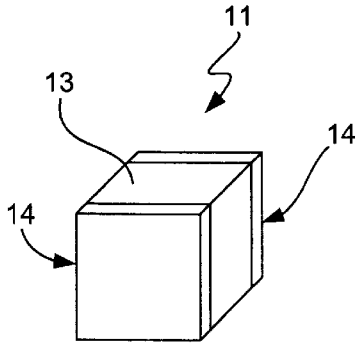

Next, as shown in FIG. 2A, a specified number of inner-layer green sheets 18 are stacked one on top of another, and one each of the outer-layer green sheets 17 is placed on top and at the bottom of these stacked inner-layer green sheets 18 such that the surfaces of the outer-layer green sheets 17 coated with the glass paste 16 face inward, or such that the printed glass paste 16 will not be exposed to the exterior. The stacked assembly is then compressed together by means of a hydraulic press to be made into an integrated body having a specified total thickness. Next, chip members 19 of a specified size, as shown in FIG. 2B, are obtained by cutting the integrated body thus obtained along specified lines such that the glass paste 16 printed on the inner-layer green sheets 18 will be on mutually oppositely facing side surfaces of the chip members 19. The chip members 19 thus obtained are subjected to a firing process at a temperature of 1000–1300° C. to obtain NTC thermistor elements 12 as shown in FIG. 2C with diffused layers 13 on all four side surfaces. In other words, as these chip members 19 are subjected to the firing process, the glass paste 16 on their outermost layers and the glass paste 16 exposed on their side surfaces are diffused to together form the diffused layers 13 near the four side surfaces of the NTC thermistor elements 12. Even in situations where the glass paste 16 exposed on a side surface of a chip member fails to diffuse sufficiently and the diffused layer 13 is not formed completely over the areas of the side surfaces but is in a multi-layered form, there is practically no problem because a certain level of insulating effect can be thereby obtained.

The reason for stacking the outer-layer green sheets 17 with their coated surfaces facing inward is to prevent the individual chip members 19 from getting attached together or to a container box by the melted glass paste during the firing process. In situations where such problems are not present, the green sheets may be stacked with some glass paste exposed externally.

Next, both end surfaces of the thermistor element 12 are coated with a silver electrode paste and baked to form baked electrode layers 14*a* serving as substrates. Thereafter, plated layers 14*b* each of a two-layer structure comprising Ni and Sn layers are formed on these baked electrode layers 14*a* by an electrolytic plating method to obtain the thermistor chip 11 of FIG. 1. The aforementioned baked electrode layers 14*a* and plated layers 14*b* are together referred to as the outer electrodes 14.

Many modifications and variations may be made to the example described above within the scope of this invention. Although not referred to with reference to FIG. 1 or 2, the thermistor chip 11 embodying this invention may include inner electrodes. Thermistor chips with inner electrodes may be produced similarly as described above except that extra electrodes are formed on the surfaces of the inner-layer green sheets 18 before these inner-layer green sheets 18 are stacked together.

Figure 3:
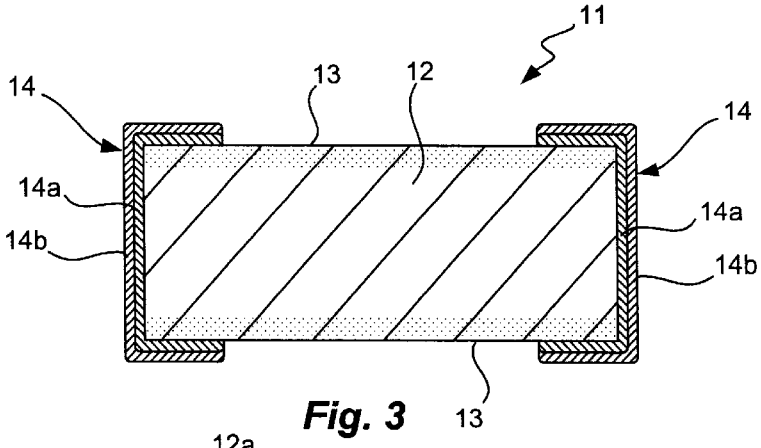
FIG. 3 is a sectional side view of another thermistor chip embodying this invention.
Figure 4:
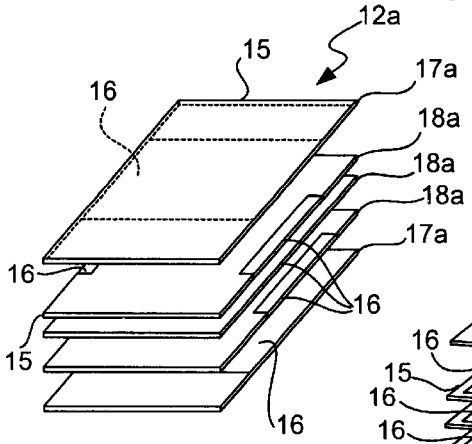
FIG. 4 is a diagonal view of components of the thermistor chip of FIG. 3 before they are assembled together.

FIG. 3 shows another thermistor chip 11*a* embodying this invention which is similar to the thermistor chip 11 of FIGS. 1 and 2 but is characterized and different therefrom wherein a diffused layer 13*a* is not formed proximally to the entire areas of the four side surfaces of the thermistor element 12*a* but only over center portions of the side surfaces not to be covered by the outer electrodes 14. FIG. 4 shows how ceramic green sheets 15 are prepared and stacked one on top of another to obtain such thermistor elements 12*a*. As shown, outer-layer green sheets 17*a* are prepared by applying a glass paste 16 in the forms of a belt on ceramic green sheets 15, excluding the end areas where the outer electrodes 14, are going to be formed. Inner-layer green sheets 18*a* are prepared by applying a glass paste 16 on both side edges of ceramic green sheets 15 by excluding the end surfaces. Specified numbers of these outer-layer and inner-layer green sheets 17*a* and 18*a* are stacked one on top of another and baked together to obtain the thermistor elements 12*a*.

The diffused layers 13 and 13*a* according to this invention need not necessarily comprise a glass material. Instead of a glass material, a material having a higher specific resistance than the thermistor element and containing one or more oxides containing a trivalent metal such as Al, Si, Ti and Sn or of a metal of higher valency and metals such as Zn, Al, W, Zr, Sb, Y, Sm, Ti and Fe may be applied, compressed and baked. By such a process, a material with a high specific resistance is diffused and a neighborhood of the outer surfaces of the thermistor element 12 becomes insulating or comes to have a higher specific resistance.

FIG. 5 shows the production of thermistor chips 11*b* according to still another embodiment of the invention, each having a thermistor element 12*b* which has the same external appearance as the thermistor element 12*a* described above, diffused layers 13 formed near its outer surfaces and outer electrodes 14 on both end surfaces of the thermistor element 12*b*. Green sheets 15, as described with reference to FIG. 2, are prepared and cut to a specified size. Next, inner-layer green sheets 18*b* are produced thereof by applying a glass paste 16 having zinc borosilicate as its principal ingredient in a lattice form with quadrangular exposed areas distributed in rows and columns, as shown in FIG. 5A, over a specified area of one of the main surfaces of the green sheets 15.

Figure 5A:
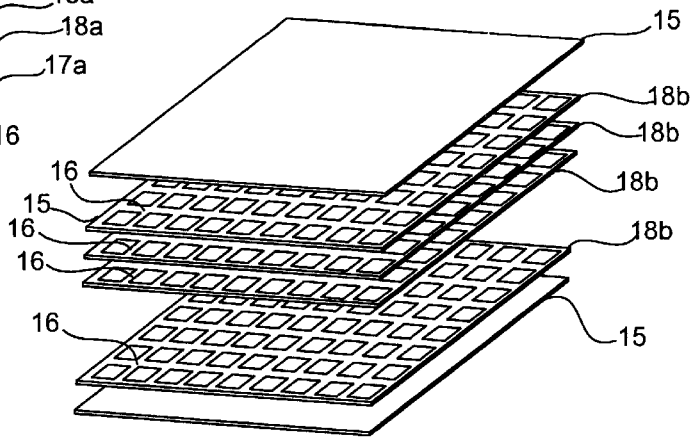
FIGS. 5A, 5B, 5C and 5D, together referred to as FIG. 5, are diagonal views of still another thermistor chip embodying this invention at various stages of its production.
Figure 5B:
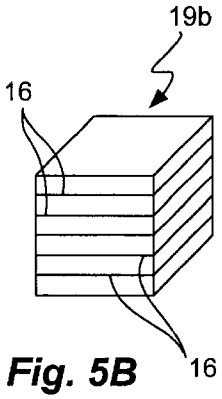
Figure 5C:
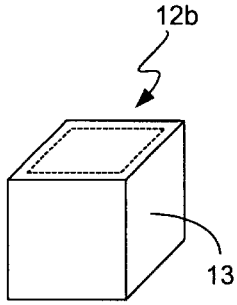

Next, a specified number of inner-layer green sheets 18*b* thus prepared are stacked one on top of another, with one uncoated green sheet 15 each placed above and below this stacked assembly, as shown in FIG. 5A, and compressed together by means of a hydraulic press to obtain an integrated body having a specified thickness. This integrated body is cut along the rows and columns of the lattice design on the inner-layer green sheets 18*b* to obtain individual chip units 19*b* as shown in FIG. 5B such that the glass paste 16 applied on the inner-layer green sheets 18*b* will be exposed on all four newly exposed cut surfaces. These chip units 19*b* are subjected to a firing process at 1000–1300° C. to obtain thermistor elements 12*b* each with diffused layers 13 formed near the four outer surfaces, as shown in FIG. 5C. In other words, the diffused layers 13 are formed as the glass paste 16 exposed at the four outer surfaces of each chip unit 19*b* in a layered form is diffused by this firing process.

Figure 5D:
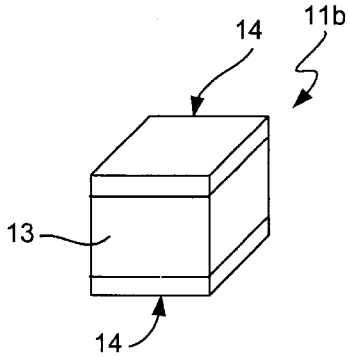

Next, an electrode-forming Ag paste is applied to form a base layer over all portions of the outer surfaces of this thermistor element 12*b* where the diffused layers 13 are not formed, inclusive of the outwardly facing main surfaces of the top and bottom layers of green sheets 15 with no diffused layer formed thereon. Baked electrode layers are formed by subjecting the electrode-forming Ag paste to a firing process, and plated layers each consisting of a Ni layer and a Sn layer are formed on these baked electrode layers to produce a thermistor chip 11*b* as shown in FIG. 5D wherein the base electrode layer and the plated layer are indicated together as the outer electrodes 14.

For producing thermistor chips (such as shown at 11*b*) with inner electrodes, inner-layer green sheets 18*c* with inner electrode are prepared each by adding an inner electrode 20 with a specified area to an inner-layer green sheet 18*b* as described above with reference to FIG. 5A. Next, inner-layer green sheets 18*d* with throughhole are prepared each by forming a throughhole 21 through an inner-layer green sheet 18*b* as described above with reference to FIG. 5A and filling this throughhole 21 with an electrically conductive paste. Two of the inner-layer green sheets 18*c* with inner electrode are superposed one above the other with a specified distance in between and a specified number of inner-layer green sheets 18*d* with throughhole are stacked thereabove and therebelow. Finally, two end green sheets

Figure 6A:
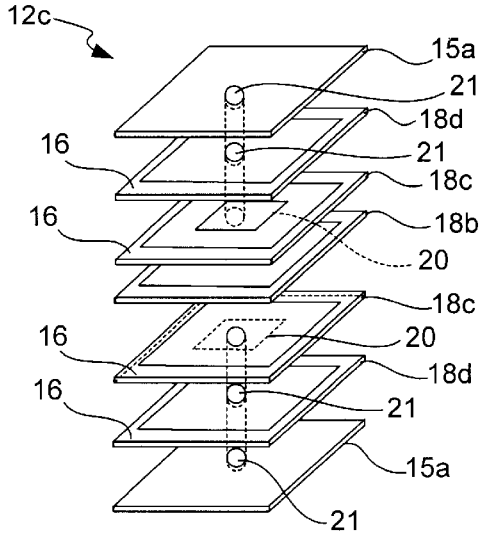
FIGS. 6A and 6B are diagonal views of a thermistor chip of FIG. 5 at various stages of adding inner electrodes thereto.
Figure 6B:
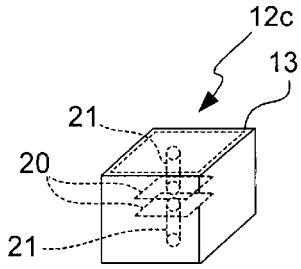
Figure 7:
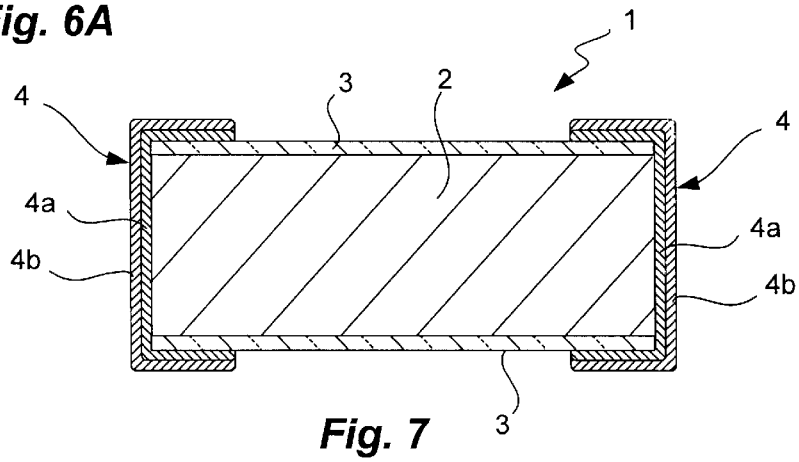
Fig. 7 (Prior Art)
FIG. 7 is a sectional view of a prior art thermistor chip.
Figure 8A:
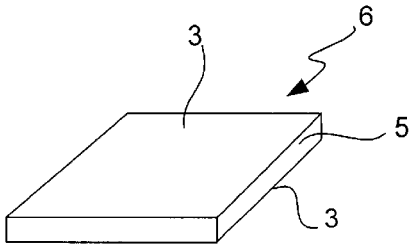
Fig. 8A (Prior Art)
FIGS. 8A, 8B, 8C and 8D are diagonal views of the prior art thermistor chip of FIG. 7 at various stages of its production.
Figure 8B:
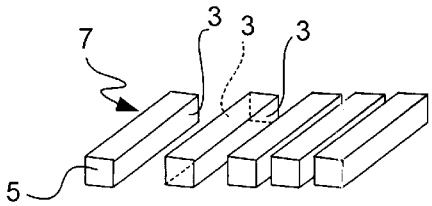
Fig. 8B (Prior Art)
Figure 8C:
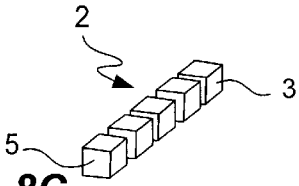
Fig. 8C (Prior Art)
Figure 8D:
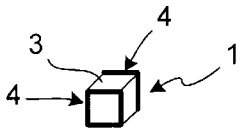
Fig. 8D (Prior Art)

15*a* are prepared each by forming a throughhole 21 in an uncoated green sheet 15 and filling it with an electrically conductive paste, and they are placed at the top and the bottom of the assembly, as shown in FIG. 6A. This stacked assembly is compressed together and subjected to a firing process to form diffusing layers 13 proximally to the four side surfaces as shown in FIG. 6B to obtain a thermistor element 12*c* with two inner electrodes 20 extending parallel to the end surfaces completely covered by the outer electrodes 14, separated from each other by a specified distance and each being connected to a corresponding one of the outer electrodes 14.

When the thermistor element 12 or 12*b* is made of a ceramic material with specific resistance less than 200 Ω cm, having as its principal component one or more oxides together containing two or more elements selected from Mn, Ni, Co, Fe, Cu and Al, the baked electrode layer 14*a* serving as the base layer of the outer electrodes 14 may be dispensed with, the plated layers 14*b* being directly formed on the thermistor element 12 or 12*b* by an electrolytic plating process.

In order to ascertain the merits of the present invention, thermistor chips as indicated by symbols 11 and 11*b* as well as thermistor chips with no diffused layers, serving as comparison examples, were prepared and the changes in their resistance values caused by an electrolytic plating process and variations in these resistance values were studied. The results of the study are shown in Table 1 wherein thermistor chips 11 and 11*b* are respectively referred to as Test Example 1 and 2.

TABLE 1

| | Diffused Layers | Fractional Change in Resistance due to Plating Process (%) | Variations in Resistance 3CV (%) |
|---|---|---|---|
| Text Example 1 | Present | 0.05 | 6.5 |
| Test Example 2 | Present | 0.1 | 6.6 |
| Comparison Example | Absent | 3.5 | 7.5 |

Table 1 shows that the fractional change in resistance due to the electrolytic plating is very small with thermistor chips 11 and 11*b* with diffused layers provided. It can also been seen that the 3CV which indicates variations in the resistance values is also small with these thermistor chips.

The strength of the thermistor chips 11 and 11*b* against breaking was also studied. Shelf tests were carried out for a period of 1000 hours in high-temperature (125° C.), low-temperature (−40° C.) and high-humidity (60° C. and 95% RH) environments to study the changes in their resistance and B-constant. The results of these tests are shown in Table 2.

TABLE 2

| | | | Shelf Tests (%) | | |
|---|---|---|---|---|---|
| | Diffused Layers | Strength (N) | 125° C. | 60° C. and 95% RH | −40° C. |
| Text Example 1 | Present | 52.6 | 0.7 | 0.7 | 0.3 |
| Test Example 2 | Present | 51.2 | 0.8 | 0.7 | 0.3 |
| Comparison Example | Absent | 36.3 | 1.3 | 0.8 | 0.4 |

Table 2 shows that the strength of thermistor chips 11 and 11*b* according to this invention is greater than that of the comparison example by over 40%. The shelf tests showed that the change in the resistance was smaller with the thermistor chips 11 and 11*b* than with the comparison example and that the difference was particularly significant in the high-temperature test. It is believed because the diffused layers 13 improved the mechanical strength of the thermistor elements 12 and 12*b* and prevented their corrosion by the electrolytic plating process.

As explained above, thermistor chips embodying this invention are characterized as having diffused layers of an inorganic material with a high specific resistance formed proximally to the external surfaces of a thermistor element so as to prevent the corrosion of the element at the time of an electrolytic plating process and the changes in the resistance value due to such corrosion of the thermistor element. Since the outer surfaces of the thermistor element can be insulated or their resistance value can be augmented only by a printing process, and since it is not required to apply any paste and to bake it, furthermore, they can be mass-produced at a reduced cost.

It should be noted that no limitation has been placed on the thermistor element 2 above regarding the resistance-temperature coefficient. This means that both positive temperature coefficient (PTC) and negative temperature coefficient (NTC) thermistor elements can be produced by a method of this invention.

What is claimed is:

1. A method of producing a thermistor chip, said method comprising the steps of:

preparing ceramic green sheets having designated lines thereon;

applying an inorganic material on said green sheets along said designated lines;

stacking a plurality of said green sheets one on top of another to obtain a stacked body and compressing together to obtain an integrated body;

obtaining chips each with four side surfaces by cutting said integrated body along said designated lines and subjecting said chips to a firing process to obtain a sintered body with diffused layers on all of said four side surfaces; and forming outer electrodes on mutually opposite end surfaces of said sintered body.

2. The method of claim 1 wherein said stacked body includes a top sheet and a bottom sheet which are stacked such that the surfaces thereof with said inorganic material applied thereon face inwardly towards each other.

3. The method of claim 1 wherein said outer electrodes are formed by the step of forming electrolytically plated layers on said end surfaces by subjecting said sintered body to an electrolytic plating process.

4. The method of claim 1 wherein said inorganic material comprises a glass paste.

5. The method of claim 1 wherein said inorganic material contains one or more oxides comprising a metal selected from the group consisting of Al, Si and Sn and metals selected from the group consisting of Zn, Al, W, Zr, Sb, Y, Sm, Ti and Fe.

6. The method of claim 1 wherein said firing process causes diffused layers to be formed proximally to selected parts of externally exposed areas of said sintered body except said end surfaces.

* * * * *